US007728808B2

(12) United States Patent
Kim

(10) Patent No.: US 7,728,808 B2
(45) Date of Patent: Jun. 1, 2010

(54) FIELD SEQUENTIAL LIQUID CRYSTAL DISPLAY

(75) Inventor: Tae-Soo Kim, Busan (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1192 days.

(21) Appl. No.: 10/998,448

(22) Filed: Nov. 29, 2004

(65) Prior Publication Data

US 2005/0116921 A1 Jun. 2, 2005

(30) Foreign Application Priority Data

Nov. 27, 2003 (KR) ..... 10-2003-0085292

(51) Int. Cl.
*G09G 3/36* (2006.01)

(52) U.S. Cl. ..... 345/102; 315/169.3

(58) Field of Classification Search ..... 345/87–102; 315/169.3, 219
See application file for complete search history.

(56) References Cited

U.S. PATENT DOCUMENTS

| | | | | |
|---|---|---|---|---|
| 6,498,592 | B1 * | 12/2002 | Matthies | 345/87 |
| 6,762,743 | B2 * | 7/2004 | Yoshihara et al. | 345/102 |
| 6,831,621 | B2 * | 12/2004 | Nakano | 345/87 |
| 6,888,529 | B2 * | 5/2005 | Bruning et al. | 345/102 |
| 7,088,334 | B2 * | 8/2006 | Adachi et al. | 345/102 |
| 7,208,713 | B2 * | 4/2007 | Ishiguchi | 250/205 |
| 7,468,721 | B2 * | 12/2008 | Nakano | 345/102 |
| 2002/0097000 | A1 * | 7/2002 | Muthu et al. | 315/169.3 |
| 2003/0214242 | A1 * | 11/2003 | Berg-johansen | 315/169.3 |
| 2003/0231161 | A1 * | 12/2003 | Yamaguchi | 345/102 |
| 2004/0036672 | A1 * | 2/2004 | Yoo et al. | 345/102 |
| 2004/0105053 | A1 * | 6/2004 | Ozeki et al. | 349/112 |
| 2005/0035940 | A1 * | 2/2005 | Lazaridis et al. | 345/102 |
| 2006/0071900 | A1 * | 4/2006 | Drader et al. | 345/102 |

(Continued)

FOREIGN PATENT DOCUMENTS

CN 1384484 A 12/2002

(Continued)

OTHER PUBLICATIONS

Patent Abstract of Japan, Publication No. 2004-086081, dated Mar. 18, 2004, in the name of Sasuga Masatoshi.

(Continued)

*Primary Examiner*—Kevin M Nguyen
*Assistant Examiner*—Kenneth B Lee, Jr
(74) *Attorney, Agent, or Firm*—Christie, Parker & Hale, LLP

(57) ABSTRACT

A field sequential liquid crystal display (FS-LCD) capable of obtaining desired chromaticity and luminance by setting driving conditions of light emitting diodes (LEDs) having a large driving current distribution per LED product, and driving a backlight including R, G, and B LEDs according to a corresponding driving condition. An LCD driving circuit prestores driving conditions for a liquid crystal and driving conditions for each of a plurality of LEDs. A liquid crystal panel in the FS-LCD is driven based on a corresponding prestored driving condition for the liquid crystal, and the R, G, and B LEDs forming the backlight are driven based on a corresponding driving condition for each LED. The liquid crystal panel also includes a temperature sensor and a luminance and chromaticity sensor. The driving conditions may vary based on sensed temperature, chromaticity, and luminance.

17 Claims, 4 Drawing Sheets

U.S. PATENT DOCUMENTS

2006/0097978 A1 * 5/2006 Ng et al. ..... 345/102

FOREIGN PATENT DOCUMENTS

| | | | |
|---|---|---|---|
| JP | 61-198197 | | 9/1986 |
| JP | 8-106264 | | 4/1996 |
| JP | 2000-137465 | | 5/2000 |
| JP | 2001-257921 | | 9/2001 |
| JP | 2001-272956 | | 10/2001 |
| JP | 2001-337392 | | 12/2001 |
| JP | 2001-343935 | | 12/2001 |
| JP | 2002100485 | A * | 4/2002 |
| JP | 2002-189220 | | 7/2002 |
| JP | 2002-231470 | | 8/2002 |
| JP | 2003-99015 | | 4/2003 |
| JP | 2003-215534 | | 7/2003 |
| JP | 2004-86081 | | 3/2004 |
| JP | 2004-253309 | | 9/2004 |
| JP | 2004-309510 | | 11/2004 |
| KR | 1999-0084247 | | 12/1999 |
| KR | 2002-0080249 | | 10/2002 |
| KR | 2002-0084125 | | 11/2002 |
| KR | 2003-0007437 | | 1/2003 |

OTHER PUBLICATIONS

Patent Abstract of Japan, Publication No. 2004-309510, dated Nov. 11, 2004, in the name of Ozaki Yutaka.
Patent Abstracts of Japan, Publication No. 2001-272956, dated Oct. 5, 2001, in the name of Hideo Mori, et al.
Korean Patent Abstracts, Publication No. 1020020080249 A, dated Oct. 23, 2002, in the name of Masanori Kimura,et al.
Patent Abstracts of Japan, Publication No. 2002-328048, dated Nov. 15, 2002, in the name of Atsushi Hatayama et al. (Corresponds to CN 1384484A listed above).
Chinese Patent Office action dated Nov. 3, 2006, for CN 2004-10103823.3.
English translation of Chinese Patent Office action dated Nov. 3, 2006 listed above.
Patent Abstracts of Japan, Publication 08-106264, dated Apr. 23, 1996, in the name of Yutaka Kashiwabara et al.
Patent Abstracts of Japan, Publication 2000-137465, dated May 16, 2000, in the name of Michio Suzuki.
Patent Abstracts of Japan, Publication 2002-189220, dated Jul. 5, 2002, in the name of Takashi Yamazoe.
Patent Abstracts of Japan, Publication 2002-231470, dated Aug. 16, 2002, in the name of Takao Inoue.
English translation of abstract for KR 10-1999-0084247 listed above.
English translation of Claims 1 & 2, for Japan Publication JP 61-198197, dated Sep. 2, 1986.
Patent Abstracts of Japan, Publication No. 2001-257921, dated Sep. 21, 2001, in the name of Kazumasa Aoki.
Patent Abstracts of Japan, Publication No. 2001-337392, dated Dec. 7, 2001, in the name of Kenji Kameyama et al.
Patent Abstracts of Japan, Publication No. 2001-343935, dated Dec. 14, 2001, in the name of Tatsuo Nakano.
Patent Abstracts of Japan, Publication No. 2003-099015, dated Apr. 4, 2003, in the name of Yutaka Ozaki.
Patent Abstracts of Japan, Publication No. 2004-253309, dated Sep. 9, 2004, in the name of Tomoaki Inuzuka.

* cited by examiner

FIELD SEQUENTIAL LIQUID CRYSTAL DISPLAY

CROSS-REFERENCE TO RELATED APPLICATION

This application claims the benefit of Korean Patent Application No. 2003-0085292, filed Nov. 27, 2003, the contents of which are hereby incorporated herein by reference in their entirety.

BACKGROUND OF THE INVENTION

1. Field of the Invention

The present invention relates to a field sequential liquid crystal display (FS-LCD), and more particularly, to an LCD capable of obtaining desired chromaticity and luminance regardless of a driving current distribution of a light emitting diode (LED).

2. Description of Related Art

A color LCD generally includes a liquid crystal panel having an upper substrate, a lower substrate, and a liquid crystal injected between the upper and lower substrates. The color LCD further includes a driving circuit for driving the liquid crystal panel, and a back-light for providing white light to the liquid crystal. Such an LCD may be mainly classified into a red (R), green (G), blue (B) color filter type or a color field sequential driving type depending on its driving mechanism.

In the color filter type LCD, a single pixel is divided into R, G, and B subpixels, and R, G, and B color filters are respectively arranged in the R, G, and B subpixels. Light is transmitted from a single back-light to the R, G, and B color filters through the liquid crystal allowing a color image to be displayed.

On the other hand, a color FS-LCD includes, R, G, and B back-lights that are arranged in a single pixel that is not divided into R, G, and B subpixels. The light of the three primary colors is provided from the R, G, and B back-lights to the single pixel through the liquid crystal so that each of the three primary colors are sequentially displayed in a time-sharing, multiplexed manner, allowing the display of a color image using a residual image effect.

FIG. 1 is a perspective view of a configuration of a typical color FS-LCD.

Referring to FIG. 1, the FS-LCD includes a liquid crystal panel 100 having a lower substrate 101 in which a thin film transistor (TFT) array (not shown) for switching is arranged to be connected to a plurality of gate lines, a plurality of data lines, and a plurality of common lines. The liquid crystal panel also includes an upper substrate 103 in which a common electrode (not shown) is formed to provide a common voltage to the common lines. The liquid crystal panel further includes a liquid crystal (not shown) injected between the upper and lower substrates.

The FS-LCD further includes a gate line driving circuit 110 for providing scan signals to the plurality of gate lines of the liquid crystal panel 100, a data line driving circuit 120 for providing R, G, and B data signals to the data lines, and a back-light system 130 for providing light corresponding to three primary colors, namely, R, G, and B colors, to the liquid crystal panel 100.

The back-light system 130 includes three back-lights 131, 133, and 135 respectively providing R, G, and B light, and a light guide plate 137 providing the R, G, and B light respectively emitted from the R, G, and B back-lights 131, 133, and 135, to the liquid crystal of the liquid crystal panel 100.

Typically, a time interval of a single frame driven at 60 Hz is 16.7 ms (1/60 s). When the single frame is divided into three subframes, as is the case for the FS-LCD, each subframe has a time interval of 5.56 ms (1/180 s). The time interval of one subframe is short enough to prevent its field change to be perceived by the human eye. Accordingly, the human eye sees the three subframes during the time interval of 16.7 ms as a single frame, resulting in the recognition of a composite color formed by the three primary colors to display the image.

In order to obtain fast operating characteristics of the LCD, the response speed of the liquid crystal should be fast and the corresponding switching speed for turning the R, G, and B back-lights on and off should also be relatively fast. In addition, in order to obtain good image quality of the LCD, light having uniform chromaticity and luminance should be emitted from each of the LEDs.

FIG. 2 is a schematic block diagram of a back-light driving circuit used in the FS-LCD shown in FIG. 1.

Referring to FIG. 2, the back-light 220 includes R, G, and B back-lights 221, 223, and 225 for sequentially emitting R, G, and B lights, respectively, per each subframe. A back-light driving circuit 210 includes a driving voltage generator 211 sequentially generating a driving voltage VLED for driving the R, G, and B back-lights 221, 223, and 225.

Among these back-lights 220, the R back-light 221 emitting the R light includes a red LED (RLED), and the G back-light 223 emitting the G light includes a green LED (GLED), and the B back-light 225 emitting the B light includes a blue LED (BLED).

The driving voltage generator 211 generates the driving voltage VLED of a same level to the R, G, and B back-lights 221, 223, and 225. The driving voltage VLED provided from the driving voltage generator 211 is supplied to an anode electrode of the RLED of the R back-light 221, an anode electrode of the GLED of the G back-light 223, and an anode electrode of the BLED of the B back-light 225.

The back-light driving circuit 210 further includes a luminance adjuster 212 that is serially connected between the back-light 220 and a ground, and that adjusts the luminance of light emitted from the back-light 220. The luminance adjuster 212 has a first variable resistor RVR that is connected between the ground and a cathode electrode of the RLED of the R back-light 221 and that adjusts the luminance of light emitted from the R back-light 221, a second variable resistor GVR that is connected between the ground and a cathode electrode of the GLED of the G back-light 223 and that adjusts the luminance of light emitted from the G back-light 223, and a third variable resistor BVR that is connected between the ground and a cathode electrode of the BLED of the B back-light 225 and that adjusts the luminance of light emitted from the B back-light 225.

In the prior art, when a forward driving voltage VLED of, for example, 4V is sequentially supplied to the R, G, and B back-lights 221, 223, and 225, the variable resistors RVR, GVR, and BVR of the luminance adjuster 212 are used to sequentially provide a driving voltage suitable for the RLED, a driving voltage suitable for the GLED, and a driving voltage suitable for the BLED. Accordingly, a suitable forward driving voltage is supplied to each of the red, green, and blue LEDs per each subframe, so that the R, G, and B back-lights 221, 223, and 225 sequentially emit light having a desired luminance. That is, in the prior art, all of the R, G, and B back-lights 221, 223, 225 are provided with the same driving voltage, such as, 4V, so that the luminance of light emitted from the R back-light 221 is adjusted by applying a forward driving voltage RVf suitable for the RLED using the first variable resistor RVR when the RLED is required to be driven.

Meanwhile, the luminance of light emitted from the G back-light 223 is adjusted by applying a forward driving voltage GVf suitable for the GLED using the second variable resistor GVR when the GLED is required to be driven. In addition, the luminance of light emitted from the B back-light 225 is adjusted by applying a forward driving voltage BVf suitable for the BLED using the third variable resistor BVR when the BLED is required to be driven.

As mentioned above, the luminance was properly adjusted in the prior art by adjusting the variable resistor. However, LEDs forming the back-light generally have a very large distribution of driving currents based on the particular LED product. The differing driving currents from LED to LED create luminance non-uniformity that cannot be solved even when the luminance is adjusted using the variable resistor. Furthermore, chromaticity also cannot be adjusted due to the differing driving current distributions from LED to LED.

SUMMARY OF THE INVENTION

The various embodiments of the present invention provide a back-light driving circuit for driving an LED in an optimized condition that is capable of obtaining uniform luminance and chromaticity despite a driving current distribution of the LED.

In an exemplary embodiment according to the present invention, a liquid crystal display (LCD) includes: an LCD driving circuit having one or more prestored driving conditions for a liquid crystal and one or more prestored driving conditions for each of a plurality of light emitting diodes (LEDs), the LCD driving circuit selecting and outputting a corresponding driving condition for the liquid crystal and a corresponding driving condition for at least one of the plurality of LEDs from among the one or more prestored driving conditions for the liquid crystal and the plurality of LEDs in response to a control signal. The LCD also includes a liquid crystal panel driven by the corresponding driving condition for the liquid crystal provided by the LCD driving circuit, a back-light including the at least one of the plurality of LEDs, and a back-light driving circuit for driving the at least one of the plurality of LEDs in the back-light based on the corresponding driving condition for the at least one of the plurality of LEDs provided by the LCD driving circuit.

The LCD driving circuit may output the corresponding driving condition suitable for the at least one of the plurality of LEDs based on a control signal provided from an external control device. The external control device for providing the control signal to the LCD driving circuit may be a central processing unit (CPU) coupled to the LCD.

The LCD driving circuit may further include a data store prestoring the one or more driving conditions for the liquid crystal and the one or more driving conditions for each of the plurality of LEDs, and a controller having a temporary storage for temporarily storing data read out from the data store. The temporary storage of the LCD driving circuit may be a register, and the data store of the LCD driving circuit may be an electrically erasable and programmable read only memory (EEPROM).

The one or more driving conditions for each of the plurality of LEDs prestored in the first storage means may be ones for adjusting chromaticity and luminance of each of the plurality of LEDs, and the LCD driving circuit outputs the corresponding driving condition for the at least one of the plurality of LEDs for adjusting chromaticity and luminance of the at least one of the plurality of LEDs. The back-light driving circuit may provide to the back-light a forward driving voltage corresponding to the corresponding driving condition for the at least one of the plurality of LEDs provided by the LCD driving circuit for adjusting the luminance of the at least one of the plurality of LEDs, and a pulse width modulation (PWM) signal corresponding to the corresponding driving condition for at least one of the plurality of LEDs for adjusting the chromaticity of the at least one of the plurality of LEDs. The corresponding driving condition for the liquid crystal prestored in the first storage means may include at least one of a driving condition based on temperature, a driving condition based on LCD mode, a driving condition based on driving frequency, a driving condition based on driving voltage, and a driving condition based on gray scale to be displayed.

The back-light driving circuit may further include a driving voltage generator receiving the corresponding driving condition for the at least one of the plurality of LEDs associated with a luminance of the at least one of the plurality of LEDs for generating a forward driving voltage of the at least one of the plurality of LEDs, and pulse width modulation (PWM) signal generator receiving the corresponding driving condition for the at least one of the plurality of LEDs associated with a chromaticity of the at least one of the plurality of LEDs for generating a PWM signal of the at least one of the plurality of LEDs.

The liquid crystal panel may further include a temperature sensor for sensing temperature of the liquid crystal panel, and a luminance and chromaticity sensor for sensing luminance and chromaticity of light transmitted through the liquid crystal. The LCD driving circuits may receive a temperature sensing signal and a luminance and chromaticity sensing signal, and may select and output an updated corresponding driving condition for the liquid crystal and an updated corresponding driving condition for the at least one of the plurality of LEDs from a data store, and may drive the liquid crystal panel and the at least one of the plurality of LEDs according to the updated corresponding driving conditions.

In another exemplary embodiment according to the present invention, a method for driving a liquid crystal display (LCD) includes: prestoring one or more driving conditions for a liquid crystal included in a liquid crystal panel and one or more driving conditions for each of a plurality of LEDs capable of generating light for the liquid crystal panel; selecting a corresponding driving condition for at least one of the plurality of LEDs and a corresponding driving condition for the liquid crystal from among the one or more prestored driving conditions for the liquid crystal and the plurality of LEDs; driving the liquid crystal based on the corresponding driving condition for the liquid crystal; generating a driving signal corresponding to the corresponding driving condition for the at least one of the plurality of LEDs; and driving the at least one of the plurality of LEDs according to the generated driving signal.

The one or more prestored driving conditions for each of the plurality of LEDs may be ones for adjusting luminance and chromaticity of each of the plurality of LEDs, and may include a PWM signal for adjusting the chromaticity and a forward driving voltage for adjusting the luminance of each of the plurality of LEDs. The one or more prestored driving conditions for the liquid crystal includes at least one of a driving condition based on temperature, a driving condition based on LCD mode, and a driving condition based on driving frequency, a driving condition based on driving voltage, and a driving condition based on gray scale to be displayed.

The method may further include detecting a temperature of the liquid crystal, and luminance and chromaticity of light transmitted through the liquid crystal; selecting updated driving conditions for the liquid crystal and the at least one of the plurality of LEDs corresponding to the detected temperature, luminance, and chromaticity from among the one or more prestored driving conditions for the liquid crystal and the plurality of LEDs; and driving the liquid crystal panel and the at least one of the plurality of LEDs according to the updated driving conditions for the liquid crystal and the at least one of the plurality of LEDs.

BRIEF DESCRIPTION OF THE DRAWINGS

The above and exemplary embodiments of the present invention will be described with reference to the attached drawings in which.

DETAILED DESCRIPTION

Figure 1:
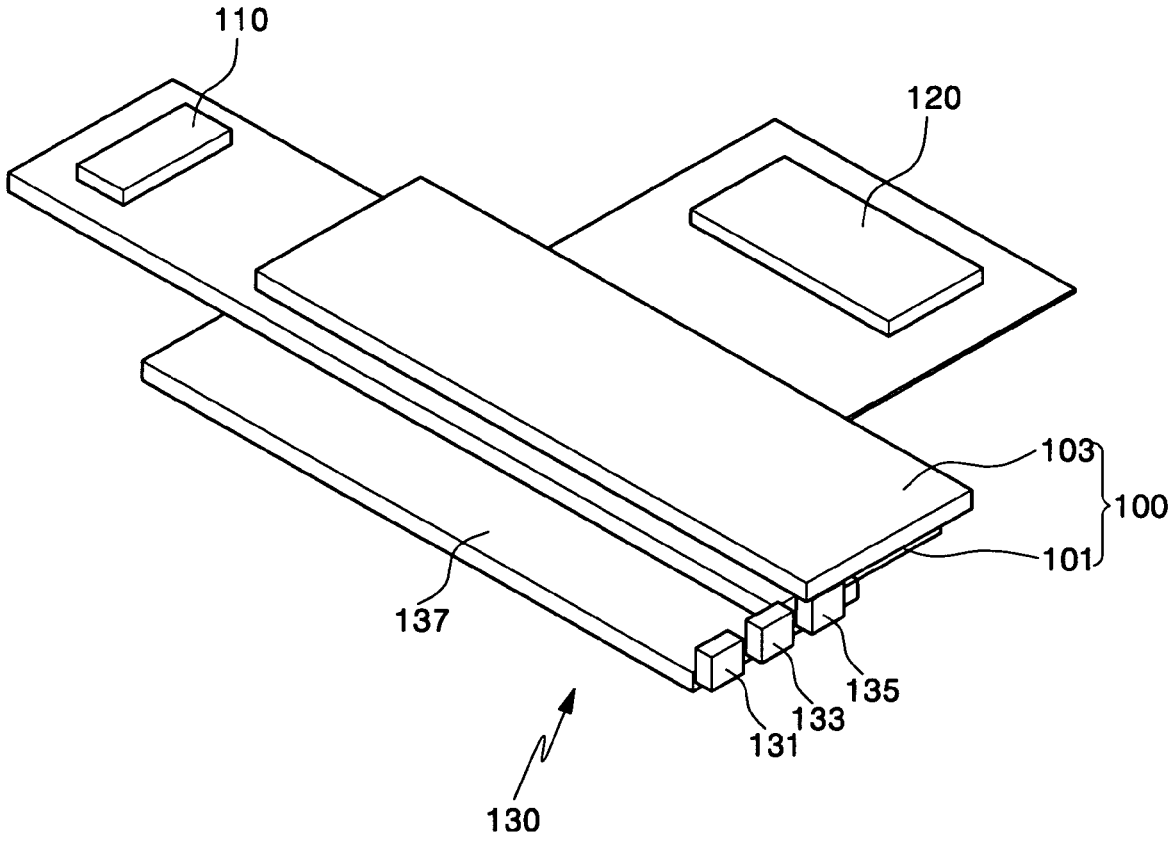
FIG. 1 (PRIOR ART)
FIG. 1 is a perspective view of a configuration of a typical color field sequential LCD.
Figure 2:
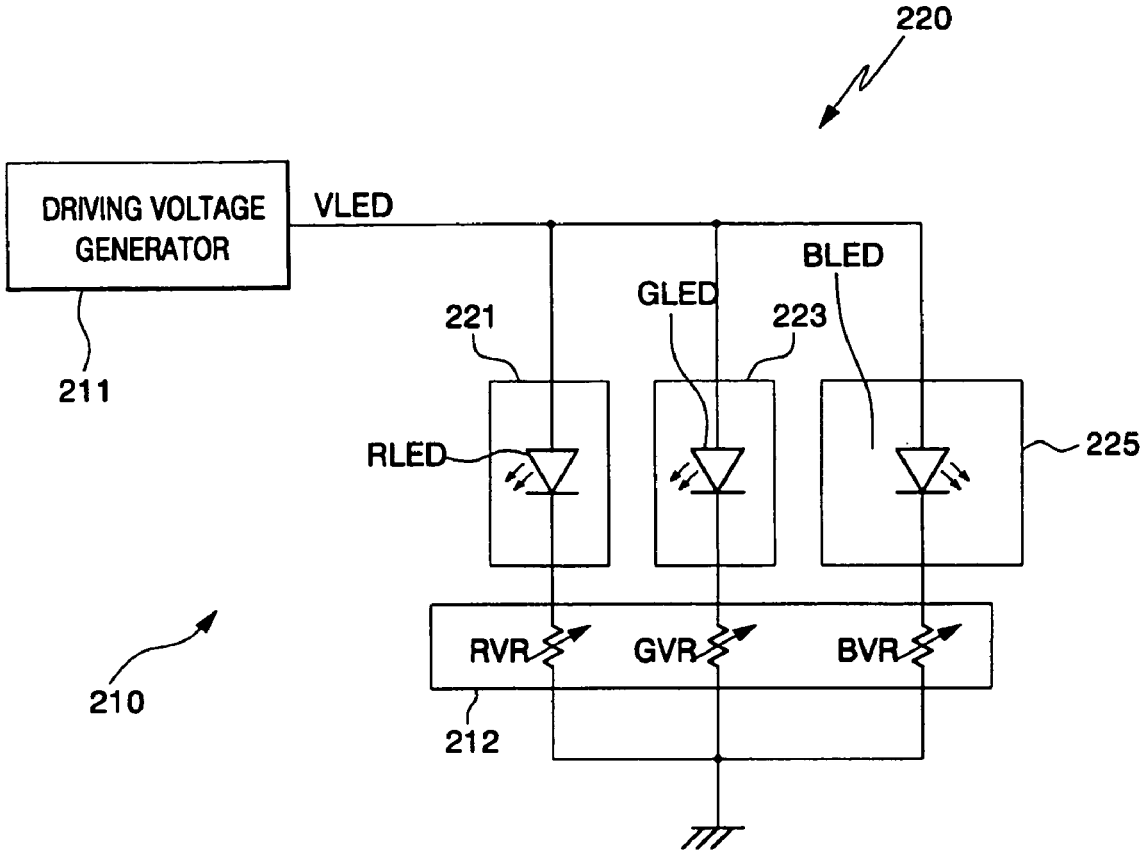
FIG. 2 (PRIOR ART)
FIG. 2 is a schematic block diagram of a back-light driving circuit used in the conventional field sequential LCD of FIG. 1.
Figure 3:
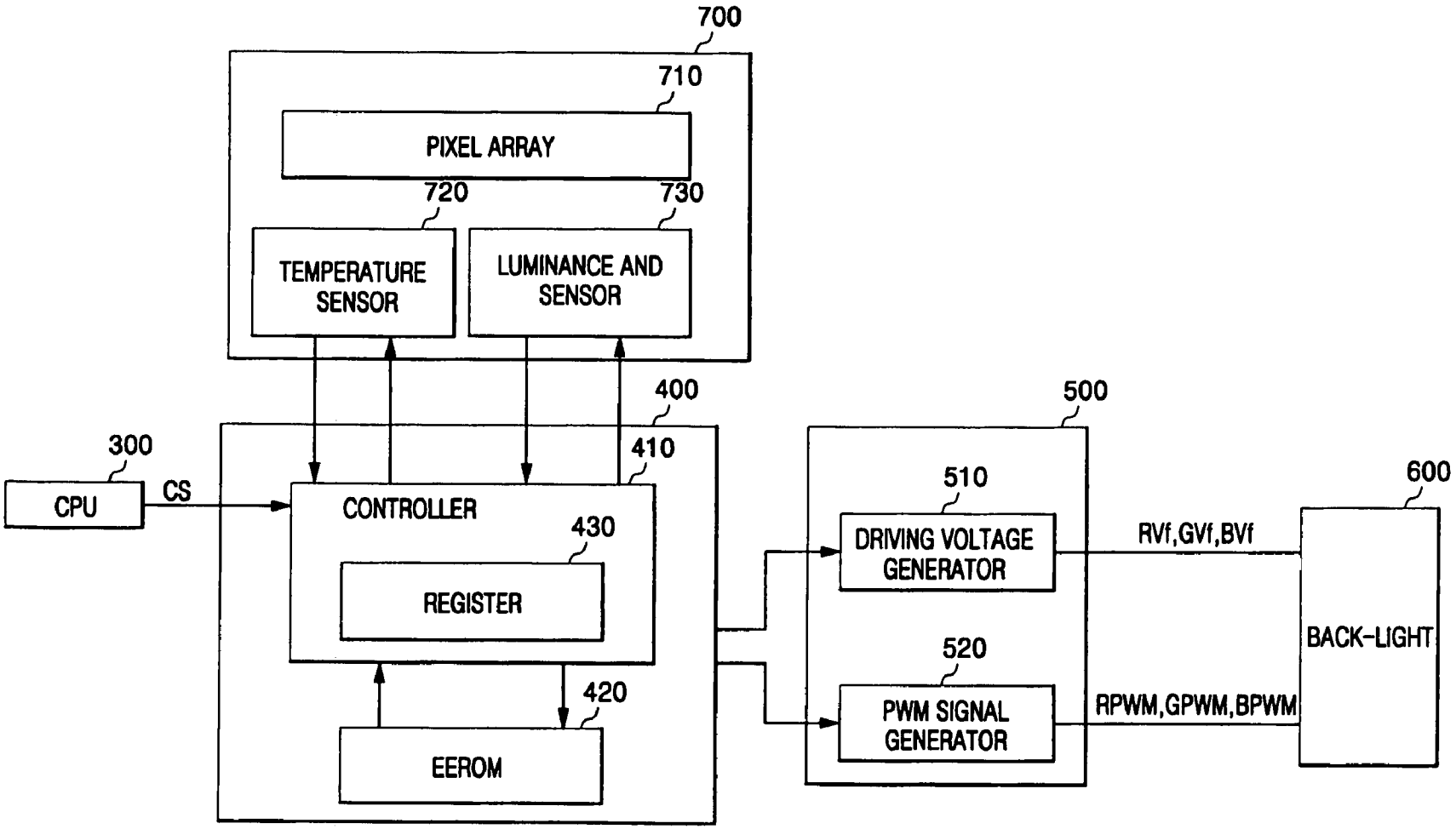
FIG. 3 is a block diagram illustrating a configuration of a field sequential LCD in accordance with embodiments of the present invention.

Exemplary embodiments of the present invention will now be described more fully hereinafter with reference to the accompanying drawings FIG. 3 is a block diagram illustrating a configuration of an FS-LCD in accordance with exemplary embodiments of the present invention.

Referring to FIG. 3, the illustrated LCD includes an LCD driving circuit 400, a back-light driving circuit 500, a back-light 600, and an LCD panel 700. A processor 300, such as, for example, a central processing unit (CPU), controls a main system connected to the LCD.

The LCD driving circuit 400 has a controller 410 and storage unit 420. The storage unit 420, which may be, for example, an electrically erasable and programmable read only memory (EEPROM), stores the driving conditions for driving the LEDs forming the back-light 600 on a per LED basis. The storage unit 420 acts to store the driving conditions for driving the FS-LCD on a per LED product basis, and as such, stores a driving condition for the LED and a driving condition for the LCD panel.

The driving condition for each LED stored in the storage unit 420 includes a pulse width modulation (PWM) value and a driving voltage for driving the LED. According to one embodiment, the driving voltage and the PWM value are values that are aimed to meet optimized driving conditions per LED product. The LCD driving conditions include, without limitation, driving conditions based on temperature, LCD mode, driving frequency, driving voltage, required gray scale to be displayed, and the like. Other driving conditions required to drive the LED and LCD which will be apparent to those of skill in the art may also be stored. In this manner, one or more driving conditions based on external factors, driving current non-uniformity of the LED, and the like, are set in advance for each LED product and stored in the storage unit 420.

For example, driving frequency, driving voltage, and turn-on time of the LED per temperature are optimized and the optimized driving condition stored in the storage unit 420 for each temperature. In case of the temperature, the response speed of the liquid crystal becomes slower when the temperature of the LCD panel is lower than a reference temperature, and the response speed of the liquid crystal becomes faster when the temperature of the LCD panel is higher than the reference temperature, calling for an adjustment in the corresponding driving frequency based on the detected temperature. According to one embodiment, the storage unit 420 stores the corresponding driving frequency, driving voltage, and turn-on time of the LED per each stored temperature.

The controller 410 includes a register 430. The register 430 acts to temporarily store driving data suitable for the LEDs forming the back-light 600 which are read from the storage unit 420 when the LCD is driven.

The back-light driving circuit 500 includes a driving voltage generator 510 and PWM signal generator 520. The driving voltage generator 510 receives a driving condition associated with the luminance of the back-light from among the driving conditions provided from the LCD driving circuit 400 to sequentially generate driving voltages, RVf, GVf, and BVf respectively suitable for the R, G, and B LEDs of the back-light 600. The PWM signal generator 520 receives a driving condition associated with the chromaticity of the back-light from among the driving conditions provided from the LCD driving circuit 400 to sequentially generate PWM signals RPWM, GPWM, and BPWM respectively suitable for the R, G, and B LEDs of the back-light 600.

Figure 4:
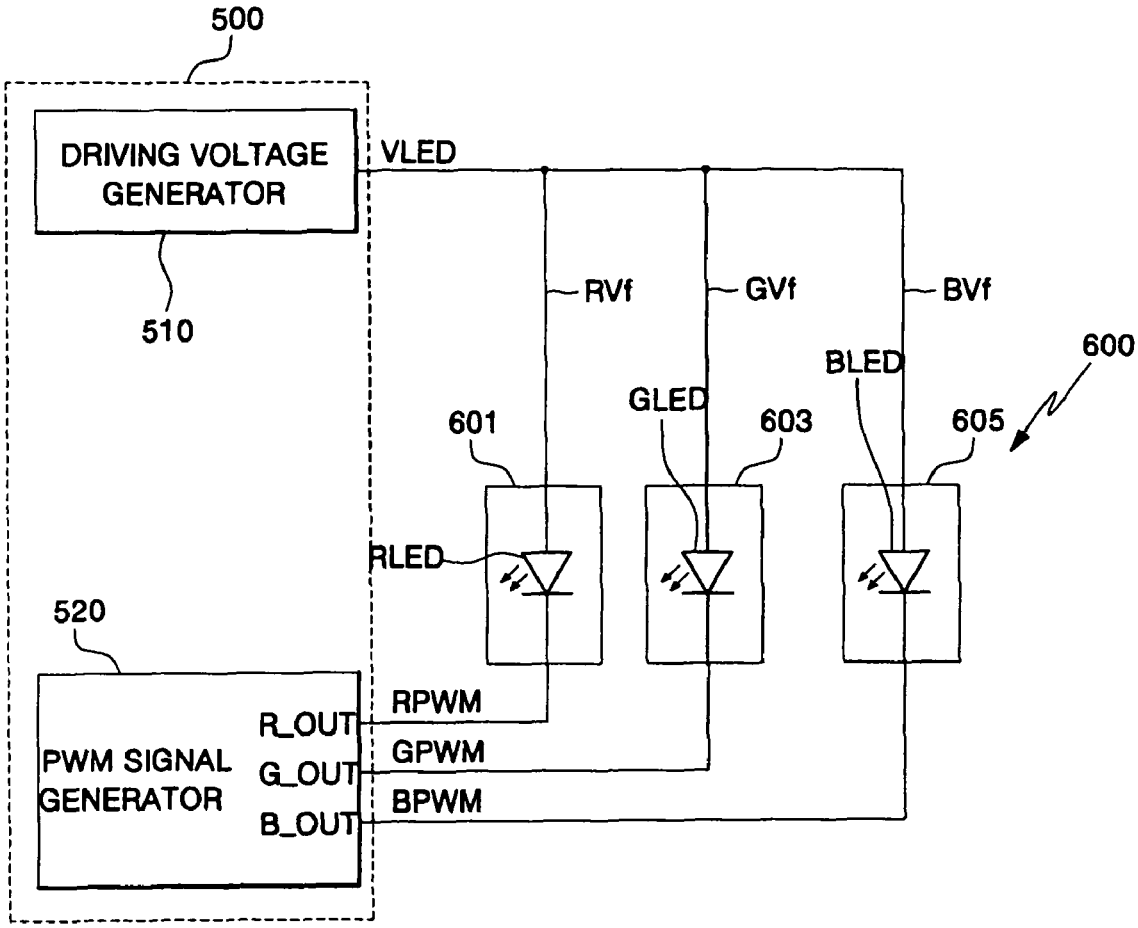
FIG. 4 is a schematic block diagram of a back-light driving circuit and an LCD driving circuit in a field sequential LCD according to an embodiment of the present invention.

The back-light 600 has R, G, and B back-lights 601, 603, and 605 as shown in FIG. 4. The R, G, and B back-lights 601, 603, and 605 respectively have R, G. and B LEDs referred to as RLED, GLED, and BLED for respectively emitting R, G, and B lights having a predetermined luminance and a predetermined chromaticity which are driven by the PWM signals RPWM, GPWM, and BPWM, and the forward driving voltages RVf, GVf, and BVf provided from the back-light driving circuit 500.

The liquid crystal panel 700 includes a pixel array 710 in which pixels are arranged in a matrix form, and gate and source drivers (not shown) for driving the pixels of the pixel array 710. In addition, the liquid crystal panel 700 further includes a temperature sensor 720 for sensing the temperature of the liquid crystal panel, and a luminance and chromaticity sensor 730 for measuring the luminance and the chromaticity of light transmitted through the liquid crystal of the liquid crystal panel 700.

Operation of the LCD having the above-mentioned configuration will be described as follows.

When the LCD is driven, the processor 300 reads out data from the storage unit 420 within the LCD driving circuit 400. The processor 300 transmits a control signal CS for reading out a driving condition for the LED and a driving condition for the LCD which are prestored in the storage unit 420, to the LCD driving circuit 400.

In the LCD driving circuit 400, the controller 410 reads out the driving condition suitable for the corresponding LED from among the driving conditions prestored in the storage unit 420 on an LED basis, responsive to the control signal CS, and temporarily stores the read driving condition in the register 430. In addition, the controller 410 reads out the corresponding driving condition from among the driving conditions for the LCD panel 700 which are prestored in the storage unit 420, and temporarily stores the read driving condition in the register 430.

Accordingly, the LCD driving circuit 400 provides the driving condition stored in the register 430 for driving the liquid crystal to the pixel array of the LCD panel 700, thereby driving the liquid crystal of the pixels arranged in the pixel array 710 via the driving condition. The LCD driving circuit 400 also provides the driving condition for each LED stored in the register 430 to the back-light driving circuit 500.

The back-light driving circuit 500 provides a driving condition for a forward driving voltage from among the driving conditions provided from the LCD driving circuit 400 to the driving voltage generator 510, and a condition for the PWM signal to the PWM signal generator 520. Accordingly, the driving voltage generator 510 generates the forward driving voltage of a particular LED, and the PWM signal generator 520 generates the PWM signal, in response to the corresponding driving condition.

As a result, LEDs forming the back-light 600 are driven by the PWM signals and the driving voltages provided from the back-light driving circuit 500, so that the back-light 600 emits light having a predetermined chromaticity and a predetermined luminance.

FIG. 4 is a schematic block diagram of the back-light 600 and the back-light driving circuit 500 according to one embodiment of the invention. The back-light driving circuit 500 drives the back-light 600 based on driving data provided for the LEDs by the LCD driving circuit 400.

In this regard, the driving voltage generator 510 receives the driving conditions for the forward driving voltage of the R, G, and B LEDs from among the driving conditions provided from the LCD driving circuit 400 as its input signal, and the PWM signal generator 520 receives the driving conditions for the PWM signals of the R, G, and B LEDs as its input signal.

Accordingly, the driving voltage generator 510 receives the driving conditions for the forward driving voltages provided from the back-light driving circuit 400 to sequentially generate the driving voltages, namely, RVf, GVf, and BVf of the R, G, and B LEDs RLED, GLED, and BLED. In addition, the PWM signal generator 520 receives the driving conditions for the PWM signals provided from the back-light driving circuit 400 to sequentially generate PWM signals, namely, RPWM, GPWM, and BPWM of the R, G, and B LEDs RLED, GLED, and BLED. As such, the luminance is adjusted by the driving voltage suitable for each of the R, G, and B LEDs, and the PWM value of each of the R, G, and B LEDs is also adjusted to thereby adjust a white balance of a color to be implemented.

For example, when one frame is divided into three subframes and the R, G, and B LEDs RLED, GLED, and BLED are sequentially driven per each subframe, the forward driving voltage RVf suitable for the RLED is provided so as to correspond to the driving condition provided from the LCD driving circuit 400 to drive the RLED in the first subframe. The forward driving voltage GVf suitable for the GLED is then provided so as to correspond to the driving condition provided from the LCD driving circuit 400 to drive the GLED in the second subframe, and the forward driving voltage BVf suitable for the BLED is provided so as to correspond to the driving condition provided from the LCD driving circuit 400 to drive the BLED in the third subframe.

As such, when the driving voltage RVf suitable for the RLED is generated to be driven in the first subframe, the light emitting period of the RLED is optimized to correspond to the driving condition provided from the LCD driving circuit 400 to have the driving current modulated by the PWM, and the light emitting periods of the GLED and BLED are also optimized to have their driving currents modulated by the PWM.

As a result, light having desired chromaticity and luminance is emitted from the R, G, and B LEDs RLED, GLED, and BLED, and the liquid crystal panel 700 allows light to be emitted and transmitted through the R, G, and B LEDs RLED, GLED, and BLED by driving the liquid crystal of the pixel array to display a desired image.

According to one embodiment of the invention, the LCD includes the temperature sensor 720 in the liquid crystal panel 700 which may be, for example, a thermistor, that senses the temperature of the liquid crystal panel 700 and provides the temperature to the LCD driving circuit 400 under control of the controller 410. The controller 410 reads out a corresponding driving condition from the storage unit 420 each time there is a change in the temperature values input from the liquid crystal panel based on temperature sensed by the temperature sensor 720

According to one embodiment of the invention, the LCD also includes the luminance and chromaticity sensor 730 in the liquid crystal panel 700 that senses the luminance and the chromaticity of light transmitted through the liquid crystal according to conventional mechanisms. Data with respect to the sensed chromaticity and luminance is provided to the LCD driving circuit 400 under control of the controller 410. The controller 410 reads out a driving condition from the storage unit 420 again, corresponding to the chromaticity and luminance data provided from the liquid crystal panel.

In this manner, the LCD driving circuit 400 provides the driving conditions for driving the liquid crystal and LED based on data associated with the sensed chromaticity, luminance, and temperature of the LCD panel 700 and the back-light driving circuit 500. As a result, the liquid crystal panel 700 and the back-light driving circuit 500 drive the pixel array 710 and the back-light 600 according to updated driving conditions provided from the LCD driving circuit 400.

As such, temperature, luminance, and chromaticity are sensed and driving conditions suitable for them are provided to drive the liquid crystal panel and the back-light, so that the optimized driving condition may allow the liquid crystal and the back-light to be driven despite the driving current distribution of the LED or the temperature of the LCD panel. Accordingly, light having the optimized luminance and chromaticity may be emitted and the resultant image quality may also be enhanced.

As mentioned above, in accordance with embodiments of the present invention, driving conditions for the liquid crystal and optimized driving conditions are first stored in a memory device on a per LED basis, and desired driving conditions for the liquid crystal and LEDs are read out to drive the liquid crystal panel and the back-light, so that an image having desired luminance and chromaticity may be displayed regardless of the non-uniform driving currents of the LEDs.

Although the present invention has been described with reference to certain exemplary embodiments, it will be understood by those skilled in the art that a variety of modifications and variations may be made to the present invention without departing from the spirit or scope of the present invention. Of course, the scope of the invention is to be determined by the appended claims and their equivalents.

What is claimed is:

1. A liquid crystal display (LCD) comprising:

an LCD driving circuit storing a plurality of first driving conditions for a liquid crystal and a plurality of second driving conditions for each of a plurality of light emitting diodes (LEDs), the LCD driving circuit for selecting and outputting a corresponding first driving condition of the plurality of first driving conditions for the liquid crystal and a corresponding second driving condition of the plurality of second driving conditions for at least one of the plurality of LEDs in response to a control signal;

a liquid crystal panel comprising a plurality of pixels configured to be driven in accordance with the corresponding first driving condition for the liquid crystal output by the LCD driving circuit;

a back-light including the at least one of the plurality of LEDs; and a back-light driving circuit for driving the at least one of the plurality of LEDs in the back-light in accordance with the corresponding second driving condition for the at least one of the plurality of LEDs output by the LCD driving circuit, wherein the plurality of first driving conditions for the liquid crystal comprises at least one of a driving condition based on temperature, a driving condition based on an LCD mode, a driving condition based on a driving frequency, a driving condition based on a driving voltage, or a driving condition based on a gray level to be displayed, and wherein the plurality of second driving conditions for each of the plurality of LEDs comprises one or more driving conditions for adjusting a luminance and a chromaticity of each of the plurality of LEDs.

2. The LCD as recited in claim 1, wherein the LCD driving circuit is configured to output the corresponding second driving condition for the at least one of the plurality of LEDs based on a control signal provided from an external control device.

3. The LCD as recited in claim 2, wherein the external control device for providing the control signal to the LCD driving circuit comprises a central processing unit (CPU) coupled to the LCD.

4. The LCD as recited in claim 1, wherein the LCD driving circuit further comprises:

a first storage unit for prestoring the plurality of first driving conditions for the liquid crystal and the plurality of second driving conditions for each of the plurality of LEDs; and a controller having a second storage unit for temporarily storing data read out from the first storage unit.

5. The LCD as recited in claim 4, wherein the second storage unit comprises a register.

6. The LCD as recited in claim 4, wherein the first storage unit comprises an electrically erasable and programmable read only memory (EEPROM).

7. The LCD as recited in claim 1, wherein the back-light driving circuit is configured to provide to the back-light a forward driving voltage corresponding to the corresponding second driving condition for the at least one of the plurality of LEDs provided by the LCD driving circuit for adjusting the luminance of the at least one of the plurality of LEDs, and a pulse width modulation (PWM) signal corresponding to the corresponding second driving condition for the at least one of the plurality of LEDs for adjusting the chromaticity of the at least one of the plurality of LEDs.

8. The LCD as recited in claim 1, wherein the back-light driving circuit further comprises:

a driving voltage generating unit for receiving the corresponding second driving condition for the at least one of the plurality of LEDs associated with a luminance of the at least one of the plurality of LEDs, for generating a forward driving voltage of the at least one of the plurality of LEDs; and a pulse width modulation (PWM) signal generating unit for receiving the corresponding second driving condition for the at least one of the plurality of LEDs associated with a chromaticity of the at least one of the plurality of LEDs for generating a PWM signal of the at least one of the plurality of LEDs.

9. The LCD as recited in claim 1, wherein the LCD is a field sequential LCD.

10. The LCD as recited in claim 1, wherein the liquid crystal panel further comprises:

a temperature sensor for sensing a temperature of the liquid crystal panel; and a luminance and chromaticity sensor for sensing luminance and chromaticity of light transmitted through the liquid crystal.

11. The LCD as recited in claim 10, wherein the LCD driving circuit is configured to receive a temperature sensing signal and a luminance and chromaticity sensing signal, to select and output an updated corresponding first driving condition for the liquid crystal and an updated corresponding second driving condition for the at least one of the plurality of LEDs from the storage unit, and to drive the liquid crystal panel and the at least one of the plurality of LEDs according to the updated corresponding first and second driving conditions.

12. A method for driving a liquid crystal display (LCD) comprising:

prestoring a plurality of first driving conditions for a liquid crystal in a liquid crystal panel and a plurality of second driving conditions for each of a plurality of LEDs configured to generate light for the liquid crystal panel;

selecting a corresponding first driving condition of the plurality of first driving conditions for the liquid crystal;

selecting a corresponding second driving condition of the plurality of second driving conditions for at least one of the plurality of LEDs;

driving the liquid crystal in accordance with the corresponding first driving condition for the liquid crystal;

generating a driving signal in accordance with the corresponding second driving condition for the at least one of the plurality of LEDs; and driving the at least one of the plurality of LEDs according to the generated driving signal, wherein the plurality of first driving conditions for the liquid crystal comprises at least one of a driving condition based on temperature, a driving condition based on an LCD mode, a driving condition based on a driving frequency, a driving condition based on a driving voltage, or a driving condition based on a gray level to be displayed, and wherein the plurality of second driving conditions for each of the plurality of LEDs comprises one or more driving conditions for adjusting a luminance and a chromaticity of each of the plurality of LEDs.

13. The method as recited in claim 12, wherein the plurality of second driving conditions adjusts the luminance and the chromaticity of each of the plurality of LEDs, by controlling a pulse width modulation (PWM) signal for adjusting the chromaticity and a forward driving voltage for adjusting the luminance of each of the plurality of LEDs.

14. The method as recited in claim 12, further comprising:

detecting a temperature of the liquid crystal;

detecting a luminance and a chromaticity of light transmitted through the liquid crystal;

selecting updated first driving conditions for the liquid crystal and updated second driving conditions for the at least one of the plurality of LEDs corresponding to the detected temperature, luminance, and chromaticity from among the prestored first and second driving conditions for the liquid crystal and the plurality of LEDs, respectively; and driving the liquid crystal panel and the at least one of the plurality of LEDs according to the updated first driving conditions for the liquid crystal and the updated second driving conditions for the at least one of the plurality of LEDs.

15. A liquid crystal display (LCD) comprising:

a liquid crystal panel comprising a plurality of pixels;

a backlight comprising a plurality of light emitting diodes (LEDs) to provide light to the liquid crystal panel;

a backlight driver for driving an LED of the LEDs, comprising a driving voltage generator coupled to a first terminal of the LED and a pulse width modulation (PWM) signal generator coupled to a second terminal of the LED; and a control unit for controlling the backlight driver, comprising a storage unit for storing a plurality of driving conditions for the LED, wherein the plurality of driving conditions for the LED comprises a plurality of first driving conditions for the driving voltage generator and a plurality of second driving conditions for the PWM signal generator.

16. The LCD of claim 15, wherein the backlight driver is configured to provide a driving voltage to the first terminal of the LED in accordance with at least one of the plurality of first driving conditions and to provide a PWM signal to the second terminal of the LED in accordance with at least one of the plurality of second driving conditions.

17. The LCD of claim 16, wherein:

the storage unit is further for storing a plurality of third driving conditions for the LCD panel;

the control unit is configured to select and output at least one of the third driving conditions to the LCD panel; and the LCD panel is configured to drive at least one of the pixels in accordance with at least one of the third driving conditions.

* * * * *